US005287638A

United States Patent [19]

Preston

[11] Patent Number: 5,287,638

[45] Date of Patent: Feb. 22, 1994

[54] WATER MASSAGE AND SHOCK ABSORPTION SYSTEM FOR FOOTWEAR

[75] Inventor: John C. Preston, Manchester, Mo.

[73] Assignee: Brown Group, Inc., St. Louis, Mo.

[21] Appl. No.: 826,841

[22] Filed: Jan. 28, 1992

[51] Int. Cl.[5] ..... A43B 13/18; A43B 13/37; A43B 13/38

[52] U.S. Cl. ..... 36/28; 36/3 R; 36/3 B; 36/29; 36/35 R; 36/43

[58] Field of Search ..... 36/3 R, 3 B, 28, 29, 36/35 R, 37, 43, 44, 114

[56] References Cited

U.S. PATENT DOCUMENTS

| | | | |
|---|---|---|---|
| 1,831,925 | 11/1931 | Niggle, Jr. | 36/35 R |
| 3,624,930 | 12/1971 | Johnson et al. | 36/3 B |
| 4,100,686 | 7/1978 | Sgarlato et al. | 36/29 |
| 4,115,934 | 9/1978 | Hall | 36/29 |
| 4,123,855 | 11/1978 | Thedford | 36/29 |
| 4,183,156 | 1/1980 | Rudy | 36/29 |
| 4,567,677 | 2/1986 | Zona | 36/43 |
| 4,776,109 | 10/1988 | Sacre | 36/3 B |
| 4,897,936 | 2/1990 | Fuerst | 36/114 |
| 4,922,631 | 5/1990 | Anderié | 36/114 |
| 5,063,692 | 11/1991 | Suginaka | 36/43 |

*Primary Examiner*—Steven N. Meyers
*Assistant Examiner*—M. D. Patterson
*Attorney, Agent, or Firm*—Polster, Lieder, Woodruff & Lucchesi

[57] ABSTRACT

An article of footwear having a water massage midsole and a shock absorption system characterized by assembling the midsole with a sock lining in the upper for directing a fluid in the midsole to flow forwardly and reversely in the footwear to massage the foot during walking. The footwear includes a shock absorbing plug in the heel area for absorbing the shock on the foot each time the heel strikes the walking surface. Further, the outsole for the footwear is formed on opposite sides of the outsole with major break indentations for rendering the forepart of the outsole and its associated portion of the upper torsionally flexible relative to the heel portion. Finally, the invention includes a method of capturing water in the water massage midsole for the article of footwear.

3 Claims, 3 Drawing Sheets

WATER MASSAGE AND SHOCK ABSORPTION SYSTEM FOR FOOTWEAR

BACKGROUND OF THE INVENTION

1. Field of the Invention

This invention is directed to a flexible footwear construction combining a system for massaging the feet and for providing shock absorption during walking.

2. Description of the Prior Art

Footwear construction has embodied many different construction characteristics with a view to providing support for the foot as well as cushion the foot in executing the usual walking motion. An example is seen in Hall U.S. Pat. No. 4,115,934 of Sep. 26, 1978 wherein a fluid filled inner sole has separate compartments to retain a certain amount of fluid in the heel as well as the ball of the foot for cushioning as the person's weight transfers from the heel to the ball in walking. A number of fluid insole devices have been proposed, such as in the Zona U.S. Pat. No. 4,567,677 of Feb. 4, 1986, or Thedford U.S. Pat No. 4,123,855 of Nov. 7, 1978, or Voorkees U.S. Pat. No. 3,990,457 of Nov. 9, 1976.

It is also known to provide a shoe with an insole having a resilient base placed inside the shoe so that a resilient heel piece can fit into a cut out in the base to form a shock absorber, and to apply a cushioning layer over the base to extend from the heel to underlie the toe area. Such a construction is disclosed in Marc U.S. Pat. No. 5,068,983 of Dec. 3, 1991.

These prior art constructions do not solve the problems of both cushioning the foot, attenuating the shock when the heel hits a solid walking surface, and also providing flexibility throughout the shoe in all walking situations.

BRIEF DESCRIPTION OF THE DRAWINGS

A more complete understanding of an exemplary embodiment of the invention can be obtained from the drawings, wherein.

DETAILED DESCRIPTION OF THE EXEMPLARY EMBODIMENT

Figure 1:
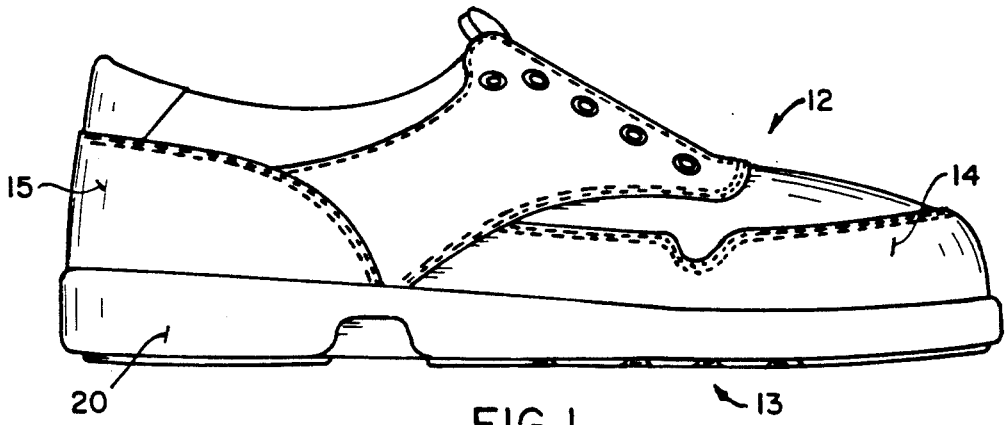
FIG. 1 is a longitudinal side view of the footwear according to the principles of the invention.
Figure 2:
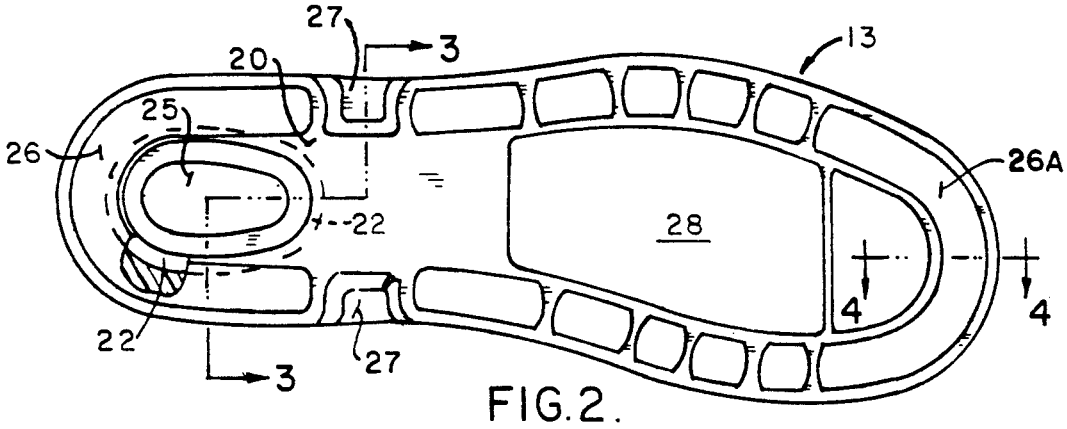
FIG. 2 is a plan view of the outsole tread surface of the shoe of FIG. 1.

In the drawings, FIG. 1 shows a shoe construction that embodies the several characteristics which makes the shoe 12 comfortable, shock absorbing, flexible, and, in addition, which affords a desirable degree of ability to massage the foot while walking in a normal manner. There are several features in the construction of the shoe that are seen in FIGS. 1 and 2 which comprise an outsole 13 which contact the walking surface, and that outsole is secured to the assembly of the foot enclosing upper 14 in the usual manner, using a suitable adhesive. The upper 14 is attached to the outsole as seen in FIG. 3 and includes the outer ply 15 and an inner foot enclosing lining ply 16, and these two plies are secured by stitching 17 to join a suitable fabric ply 18 to the flanges 19 that are formed when the outer ply 15 and lining ply 16 are turned inwardly during the lasting operation which imparts the shape to the shoe 12.

Figure 3:
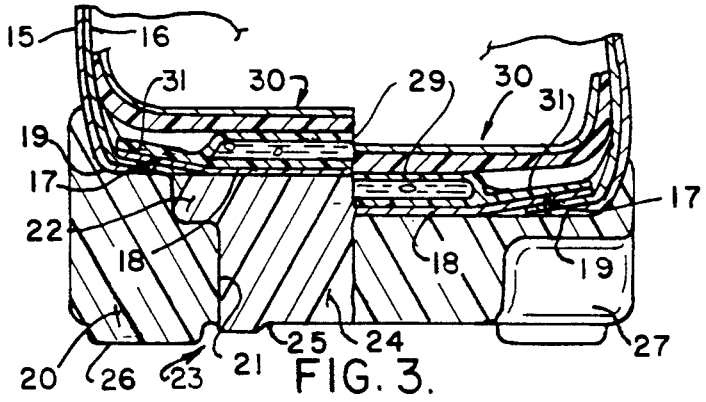
FIG. 3 is a transverse stepped sectional view of structural features taken along line 3—3 in FIG. 2.

Prior to installing the fabric ply 18, the heel area 20 of the outsole 13 is formed with an aperture 21, as seen in FIG. 3, to receive the flanged inner end 22 of a plug-type shock absorber body 23 which is cemented in place. That body 23 has an extension 24 which passes completely through the aperture 21 to present an exterior surface 25 that lies substantially flush in the outsole tread surface. When walking, the foot hits the walking surface, and the foot feels the flanged end 22 of the plug absorber 23. As can be seen in FIG. 2 the plug surface 25 is exposed within the formation of a raised U-shaped pad 26. The dimensional characteristic of the pad 26 in relation to the shock absorber surface 25 is such that the pad 26 is normally slightly higher to provide a strike area that contacts the walking surface first. Then, as the body weight is applied to push on the flange 22, the plug body 23 makes a secondary contact of its surface 25 with the walking surface to absorb the energy that would normally be applied only to the pad 26. While the plug surface 25 reacts in a shock absorbing manner, as the foot rolls forward to transfer weight to the ball area of the shoe 12, a reverse or rebound reaction occurs in the plug body 23 to apply stored energy to lift the heel upwardly.

Figure 4:
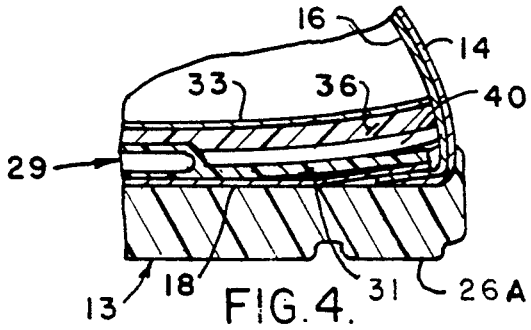
FIG. 4 is a fragmentary structural detail seen along line 4—4 in FIG. 2.

Turning now to FIGS. 1 and 2 it is observed that the outsole 13 is formed with a pair of major breaks or indentations 27 located just forward of the location of the shock absorber body surface 23 which is using the shank area. These breaks 27 function to allow for independent torsion reaction in the shank area between the heel area defined by the U-shaped pad 26 and the area of the forward contact surface 28 of the outsole 13. One function resulting from this independent torsion reaction is that the heel area of the pad 26 establishes for the foot a resistance to torsion or twisting that may occur in the forward surface 28 which ends with a toe pad 26A (see FIG. 4). Since the heel area has established an initial resistance to torsion, should the contact surface 28 and the pad 26A of the fore part encounter an object that causes it to twist, the foot and ankle are effectively rendered resistant to a severe twist. Accordingly, the major breaks 27 impart generally advantageous flexibility to the outsole 13 which is an effective aid to the walking motion.

Figure 8:
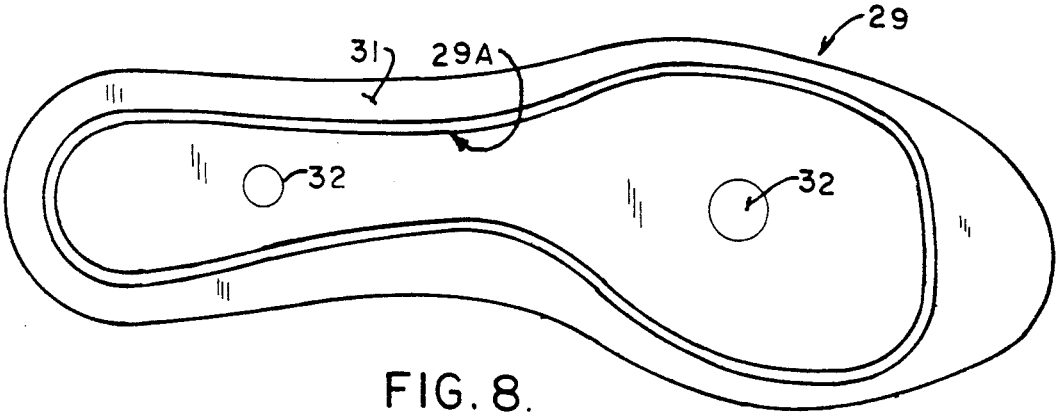
FIG. 8 is a longitudinal plan view of the bottom surface of a water containing inner sole massage element to be placed against the surface of the orthodic seen in FIG. 5.
Figure 9:
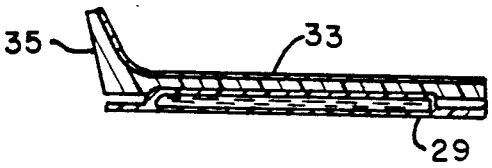
FIG. 9 is a transverse sectional detail of the assembly when the midsole massage element is placed on the surface of the orthodic seen in FIG. 5, the sectional detail being created by the same stepped section that produced FIG. 7.

A further important characteristic of the construction of the shoe 12 resides in the provision of a foot massaging inner sole 29 and the cooperating orthodic means 30, both being installed within the shoe 12. The installed position of these two parts can be seen in FIG. 3 where the foot massaging inner sole 29 is placed upon the fabric ply 18 and the orthodic means 30 is placed upon the inner sole 29 to act as a sock lining and to maintain the inner sole 29 in its intended position. In the view of the inner sole 29 of FIG. 8, the entire margin 31 forms a seal between the bottom and top layers of polyvinylchloride (P.V.C.) which enclose a body of liquid such as water. The layers thereof enclose a frozen cube of water of 2 ml. volume to which a coloring medium has been added. The method of creation of the massage effect in the inner sole 29 is to enclose the frozen cube between the superposed layers and then heat seal the layers to form the margin 31. The frozen state of the liquid makes it possible to limit the air entrapment so that a very small air bubble 32 remains in the liquid as the two layers of the P.V.C. are heat sealed. The resulting seal in the margin 31 is found to be resistant to leakage up to at least 500 pounds pressure. The liquid inside the inner sole 29 does not fully fill the cavity, thereby allowing for a flowing and massaging effect on the foot as the liquid travels back and forth during the walking motion of the shoe. The openness of the cavity in the inner sole 29 maximizes a flow comfort and shock absorption as the liquid is displaced in response to the rolling motion of the foot during walking.

Figure 5:
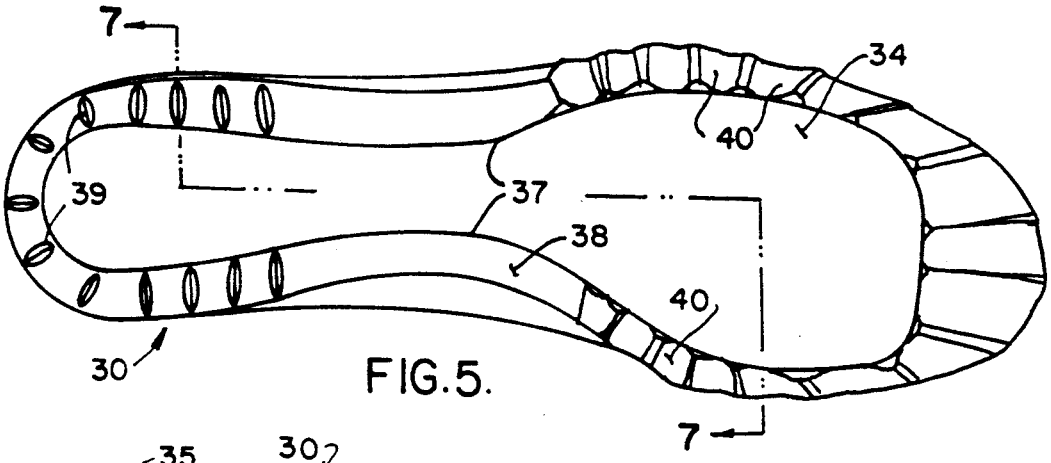
FIG. 5 is a longitudinal plan view of the bottom surface of an orthodic insert for the shoe of FIG. 1.
Figure 6:
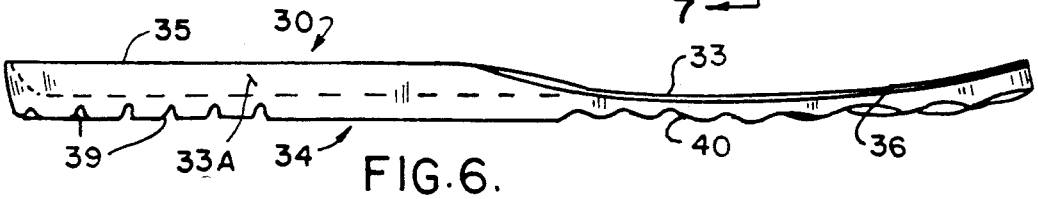
FIG. 6 is a longitudinal elevational view of the side of the orthodic seen in FIG. 5.
Figure 7:
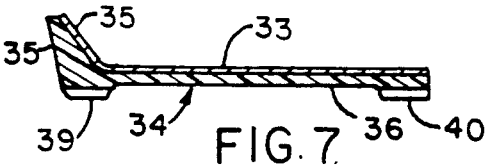
FIG. 7 is a transverse stepped sectional detail of the orthodic taken along line 7—7 in FIG. 5.

It is intended to protect the inner sole 29 from direct contact with the foot by placing the orthodic 30 on top to function as a sock lining. Reference is made to FIGS. 5, 6 and 7 which show respectively a ply of material over the upper surface 33 and a body of molded ethylene vinyl acetate 33A having the lower surface 34 thereof. The upper surface is a suitable material 33 which is dished in the heel and instep area at the margin 35. That dished margin 35 tapers into a relatively flat forepart 36. The bottom surface 34 is configured by molding to form a central recessed area indicated by outline 37. That outline is defined within a raised margin 38, which has a shape substantially matching the liquid containing cavity 29A of the inner sole 29. It can be seen best in FIG. 5 that the raised margin 38 is formed with laterally or outwardly directed slots or passages 39 in the heel area, and relative wider passages 40 in the margin of the forepart. These slots and passages provide for the transfer of air internally of the shoe 12. Thus under the compressive weight of the foot these slots 39 and passages 40 tend to collapse and force the movement of air internally around the foot to effect cooling and reduce heat buildup.

Turning again to FIGS. 2 and 3 it can be appreciated that when the heel plug 25, the inner sole 29 and insert 30 work together during walking, the foot rolls forward from the initial contact of the heel pad 26 with the walking surface where the plug 23 absorbs the secondary shock, the liquid in the inner sole 29 flows forward to massage the foot while the plug 23 imparts its rebound energy. As the weight moves forward into the forepart of the shoe, the liquid flows reversely thus not impeding the forward thrust of the foot and again massages the foot. Furthermore, as the walking motion continues, the orthodic insert 30 is progressively compressed to cause the collapse of the slots 39 and passages 40 so that air is set in motion in the shoe to cool the interior and thereby reduce heat buildup.

Figure 10:
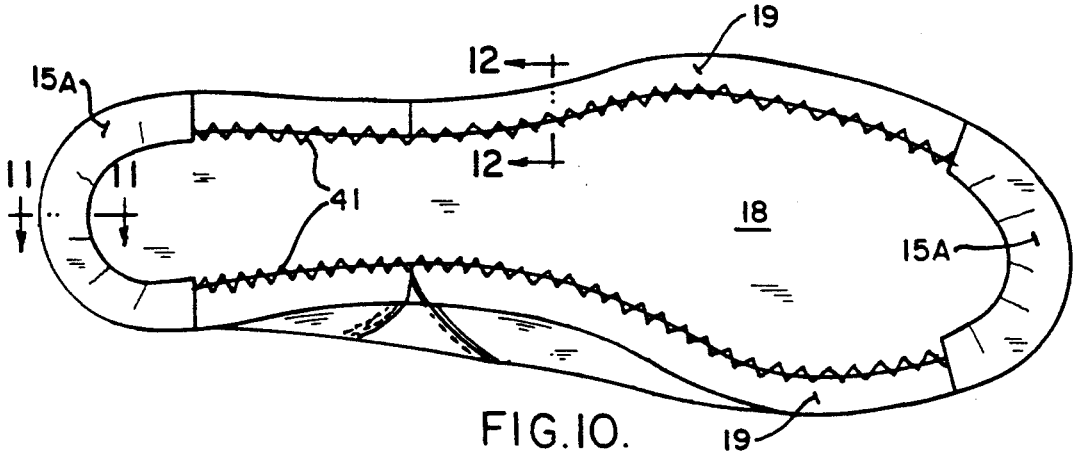
FIG. 10 is a bottom plan view of the assembly of the shoe upper stitched to a fabric liner except at the toe and heel of the upper.
Figure 11:
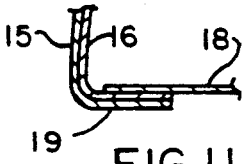
FIG. 11 is a sectional detail of the assembly of FIG. 10 taken along line 11—11 in FIG. 10.
Figure 12:
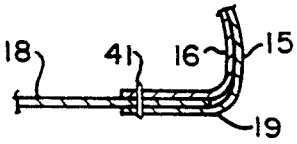
FIG. 12 is a sectional detail of the assembly of FIG. 10 taken along line 12—12 in FIG. 10.

The features described above are to be assocaited with a shoe 12 of the character seen in FIG. 1 when lasted to the body of the outsole 13 shown in FIG. 2. In the embodiment seen in FIGS. 10, 11 and 12, the fabric ply 18 is stitched by the strobile stitching 41 directly to both the outer ply 15 and inner lining ply 16 along the margins between the location where a portion 19 of the outer ply 15 is folded under the inner lining 16 and fabric ply 18 as shown in FIG. 11 which is typical for both heel and toe. In these two areas, the outer ply 15 is suitably cemented to the underlying plies 16 and 18. The stitching attachment 41 for the intervening lengths of the outer ply 15 and its lining ply 16 is shown in FIG. 12.

Figure 13:
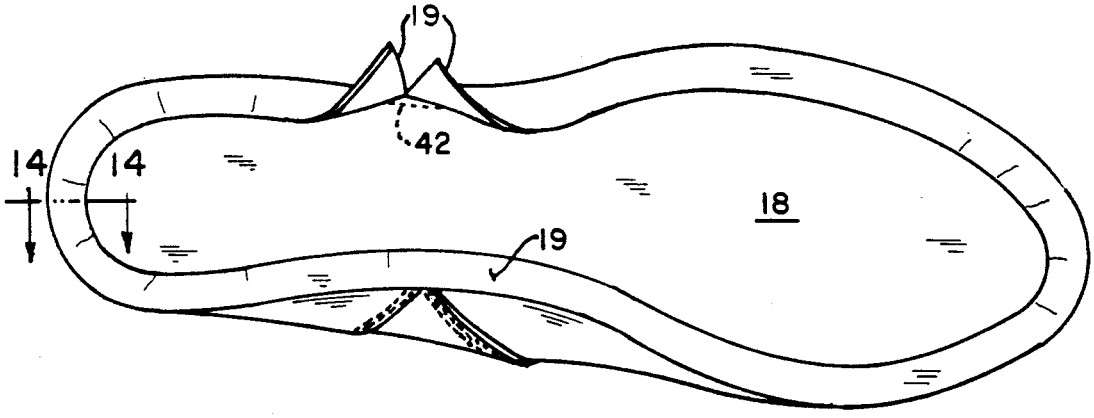
FIG. 13 is a bottom plan view of a modified assembly of the shoe upper lasted over a fabric liner stitched to the liner in the outer ply of the upper.
Figure 14:
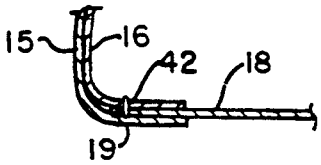
FIG. 14 is a sectional detail taken along line 14—14 in FIG. 13.

A modified embodiment of assembly of the upper to the fabric 18 is seen in FIGS. 13 and 14. Here, the lining ply 16 is stitched to the fabric ply 18 by a line of stitching 42 which extends around the perimeter of the fabric ply 18. The detail of this perimeter stitching is exemplified in FIG. 14 where the outer ply 15 has its marginal flange 19 cemented in position. The view of FIG. 13 has been drawn to show the line of stitching 42 by lifting the flange 19 sufficiently to show that stitching 42.

While the embodiment described herein has made reference to structural features, it is understood that modifications and variations may come to mind without departing from the intended scope of the invention.

What is claimed is:

1. An article of footwear comprising:

a) an upper formed to receive and support a foot and having a marginal flange;

b) a fabric liner stitched to said upper along a line set inwardly of said upper marginal flange thereby leaving said marginal flange to be lasted over said fabric inwardly of said stitch line;

c) an outsole secured to said upper to enclose said lasted margin of said upper, said outsole having a heel area and a forepart area and a shallow cupped configuration to permit said outsole to form a mating line with said upper and extending around the footwear;

d) a fluid containing inner sole positioned on said fabric liner to conform substantially to the shape of said line of stitching of said liner to said upper;

e) a sock lining seated upon said fluid containing inner sole to present an exposed surface to receive a foot, said sock lining having an under surface presented to said fluid containing inner sole, said under surface being formed with a raised margin surrounding the margins thereof and vent passages formed in said raised margin; and f) shock absorber means carried in said outsole in position to absorb the shock of the footwear heel area in walking.

2. The article of footwear set forth in claim 1 wherein said outsole is formed with a street surface having marginal wear pad means extending from the instep around the toe, an elongated wear pad in the heel area, and break cavities in opposite margins between said heel wear pad and said marginal wear pad means adjacent the instep.

3. The footwear set forth in claim 1 wherein said outsole is formed with a heel area having an opening extending into the interior of said upper to be covered by said liner; said opening being adapted to receive said shock absorber means.

* * * * *